US009891016B2

(12) United States Patent
Leimer

(10) Patent No.: US 9,891,016 B2
(45) Date of Patent: Feb. 13, 2018

(54) FIREARM WITH A HAMMER MECHANISM

(71) Applicant: L & O Hunting Group GmbH, Isny (DE)

(72) Inventor: Jan Leimer, Mastecko Trnavka (CZ)

(73) Assignee: L & O HUNTING GROUP GMBH, Isny (DE)

( * ) Notice: Subject to any disclaimer, the term of this patent is extended or adjusted under 35 U.S.C. 154(b) by 0 days.

(21) Appl. No.: 15/365,010

(22) Filed: Nov. 30, 2016

(65) Prior Publication Data

US 2017/0153079 A1 Jun. 1, 2017

(30) Foreign Application Priority Data

Dec. 1, 2015 (DE) ..... 20 2015 106 525 U

(51) Int. Cl.

| | |
|---|---|
| ***F41A 19/14*** | (2006.01) |
| ***F41A 17/80*** | (2006.01) |
| ***F41A 19/30*** | (2006.01) |
| ***F41A 19/13*** | (2006.01) |
| ***F41A 19/44*** | (2006.01) |
| *F41A 3/34* | (2006.01) |
| *F41A 5/26* | (2006.01) |

(52) U.S. Cl.

CPC ..... *F41A 19/14* (2013.01); *F41A 17/80* (2013.01); *F41A 19/13* (2013.01); *F41A 19/30* (2013.01); *F41A 19/44* (2013.01); *F41A 3/34* (2013.01); *F41A 5/26* (2013.01)

(58) Field of Classification Search

CPC ..... F41A 19/14; F41A 19/13; F41A 19/26; F41A 19/27; F41A 19/43

See application file for complete search history.

(56) References Cited

U.S. PATENT DOCUMENTS 2,868,081 A * 1/1959 Grover ..... F41A 19/70 89/135
4,121,364 A * 10/1978 Kaltenegger ..... F41A 3/04 42/32
2015/0323268 A1* 11/2015 Kokinis ..... F41A 11/02 89/193

FOREIGN PATENT DOCUMENTS

DE 1896011 U 7/1964
DE 102014109567 A1 1/2016

OTHER PUBLICATIONS

Search Results for related German Patent Application No. 10 2015 120 808.3.

* cited by examiner

*Primary Examiner* — Stephen Johnson
(74) *Attorney, Agent, or Firm* — Paul D. Bianco; Katharine Davis; Fleit Gibbons Gutman Bongini & Bianco PL

(57) ABSTRACT

A firearm with a housing, a barrel fastened to the housing, a bolt for closure of a chamber provided in barrel, and a hammer mechanism to operate a firing pin arranged in the bolt. The hammer mechanism contains a hammer strut arranged between the firing pin and a cocking piece, offset parallel to the firing pin.

20 Claims, 3 Drawing Sheets

FIREARM WITH A HAMMER MECHANISM

FIELD OF THE DISCLOSURE

The disclosure relates to a firearm with a hammer mechanism.

BACKGROUND

This type of firearm is known under the name Sauer 303. It also contains a housing, a barrel fastened to the housing, a bolt assembly for closure of a cartridge chamber provided in the barrel and a hammer mechanism to activate a firing pin arranged in the bolt assembly. The hammer mechanism in this known gas-operated firearm consists of a hammer mounted to rotate on a trigger housing, which acts directly on the firing pin arranged in the bolt assembly.

SUMMARY

A firearm of the type just mentioned with an alternative hammer mechanism is disclosed. Expedient modifications and advantageous embodiments are also disclosed.

In an embodiment, the hammer mechanism in the firearm according to the disclosure has a hammer strut arranged between the firing pin and a cocking piece offset parallel to the firing pin. A connection can be made via this hammer strut between the cocking piece arranged in the housing behind a magazine shaft and the firing pin arranged in the bolt assembly.

The hammer strut expediently runs above and along a downwardly open magazine shaft arranged in the housing and in a particularly advantageous embodiment can be guided to move in a longitudinal groove on the inside of a rear part of the barrel parallel to the center line of the barrel.

In a preferred embodiment, the hammer strut has a front crosspiece and a rear crosspiece for connection to the firing pin and the cocking piece. The crosspieces expediently protrude inward for contact with the cocking piece and activation of the offset firing pin.

A cocking element cooperating with the firing pin and operable by the hammer strut can be arranged on the bolt assembly to activate the firing pin in another advantageous embodiment. The cocking element can be designed in the form of a lever and attached with one end to the rear end of the bolt assembly to pivot about a pin offset laterally relative to the longitudinal axis of the bolt assembly and perpendicular to the longitudinal axis. The other end of the lever-like cocking element can be designed as a free end protruding laterally relative to the bolt assembly for contact with the hammer strut.

The cocking element in another advantageous embodiment can be arranged to pivot in a transverse groove on the rear end of the bolt assembly and designed in the form of a wedge with an oblique surface facing the firing pin.

The cocking element can be expediently arranged to rotate on a breech lock mount insertable into the housing around a transverse pin between a rear starting position and a front firing position. The cocking piece is acted upon by a cocking spring, which is stretched between the cocking piece and a cocking lever movable by means of a cocking slide between a rear uncocked position and a front cocked position. The cocking spring is therefore only tensioned when the locking lever is moved into a cocked position via the cocking slide.

BRIEF DESCRIPTION OF THE DRAWINGS

Additional details and advantages of the disclosure are apparent from the following description of a preferred embodiment example with reference to the drawing. In the drawing.

DETAILED DESCRIPTION

Figure 1:
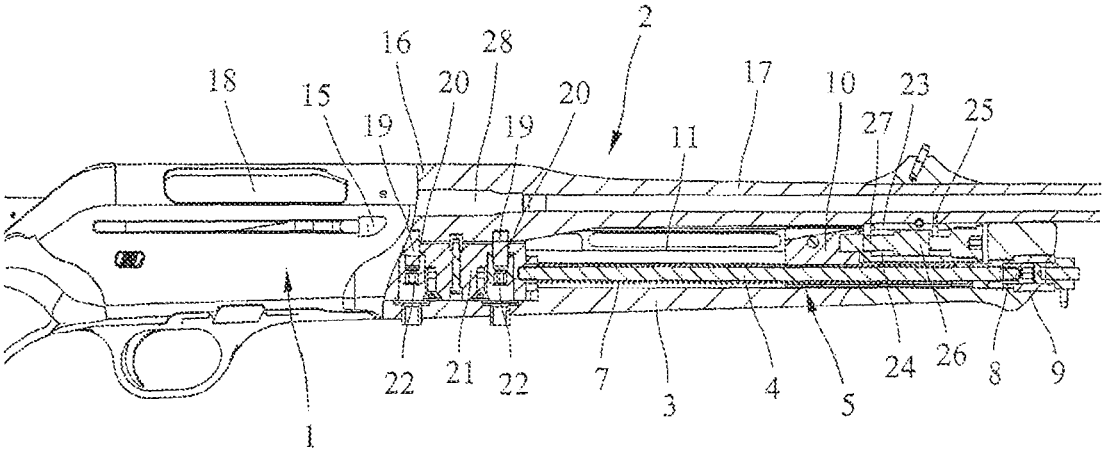
FIG. 1 shows a partial longitudinal section of gas-operated firearm.

A partial longitudinal section of a gas-operated firearm is depicted in FIG. 1 with a receiver or housing 1, a barrel 2 mounted on housing 1 and a front shaft 3. A guide rod 4 protruding forward when viewed in the direction of firing and parallel to the center line of barrel 2 is fastened to housing 1. A bolt-operating device 5 for movement of a bolt 6 depicted in FIGS. 2 to 6 is guided to move on the guide rod 4 freely protruding forward and not fastened to barrel 2. A recoil spring 7 is also arranged on the guide rod 4, via which the bolt-operating device 5 is forced forward. The front shaft 3 with its front end viewed in the direction of firing is fastened on the guide rod 4 via external threads 8 on the front free end of guide rod 4 and a threaded sleeve 9 provided with corresponding internal threads.

The bolt-operating device 5 has a carrier 10 guided to move on the guide rod 4 and two push rods 11 fastened to carrier 10. Each rear free end of the two push rods 11, viewed in the direction of firing, contains a ramp-like control cam (not shown here), via which the bolt 6, provided with lateral protrusions 12 and depicted in FIG. 2, can be moved between an upper locked position depicted in FIG. 3 and a lower unlocked position by displacement of the operating device 5. The bolt-operating device 5 is forced forward, viewed in the direction of firing, via the bolt spring arranged on guide rod 4 and stretched between housing 1 and carrier 10. In this position, the bolt 6 is forced upwards, so that a locking block 13 protruding upwards from the top on bolt 6 enters into engagement according to FIG. 3 in a locking groove 14 on barrel 2. If the bolt-operating device 5, on the other hand, is pushed rearward, viewed in the firing direction, either via a bolt handle 15 or the gas pressure during firing of a shot against the force of the bolt spring 7, the bolt 6 can be moved downwardly due to the control cam and the locking block 13 can disengage from the locking groove 14 on barrel 2 for opening of the bolt.

It follows from FIG. 1 that the barrel 2 has a rear part 16 that can be mounted on housing 1 and firmly connected to it and a front part 17 freely protruding from lock housing 1. The rear part 16 enlarged in diameter relative to front part 17 of the barrel 2 has a front area closed in the peripheral direction and a rear area opened downwardly. A side ejection opening 18 for cartridge ejection is provided in the tunnel-like rear area with the cross section of an annular segment on the rear part 16 of barrel 2. The rear part 16 and the front part 17 of barrel 2, when viewed in the direction of firing, are made from a single piece in the depicted embodiment. The two parts 16 and 17 of barrel 2, however, can also be made as individual parts, connected and firmly joined to each other, for example, by soldering or another appropriate means of connection.

Two radially protruding retaining pins 19 are provided on the rear part 16 of barrel 2 lying on housing 1 for fastening of barrel 2 to housing 1. The retaining pins 19 are provided with external threads and can be radially inserted into the rear part 16 of barrel 2 or directly molded onto the barrel 2. The retaining pins 19 are designed for engagement in two holes 20 arranged next to each other in a protruding support part 21 of housing 1. The barrel 2 can be fastened to housing 1 via the two retaining pins 19 with the freely protruding front part 17 through two nuts 22 accessible from the bottom of housing 1. The rear end of the front shaft 3 is also fastened to the support part 21 of lock housing 1. A downward protruding gas-discharge block 23 is provided in the middle area of the barrel 2 on front part 17.

As follows from FIG. 1, the gas-discharge block 23 has a gas cylinder 24 with a gas-discharge hole 25 opening into barrel 2 and a pressure piston 26 guided to move axially in gas cylinder 24. The pressure piston 26 contains a piston rod 27 extending through a rear hole in the gas-discharge block 23, which cooperates with the carrier 10 of the bolt-operating device 5 to move the bolt 6 into the unlocked position.

Figure 2:
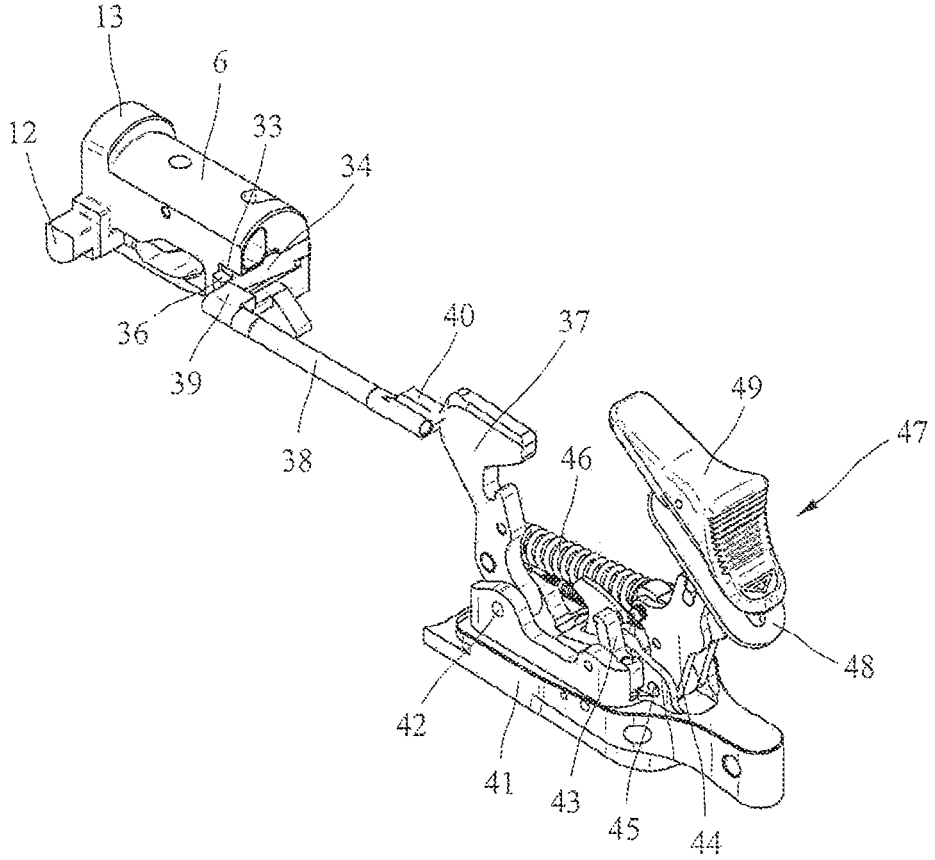
FIG. 2 shows a breech lock of the gas-operated firearm depicted in FIG. 1.
Figure 3:
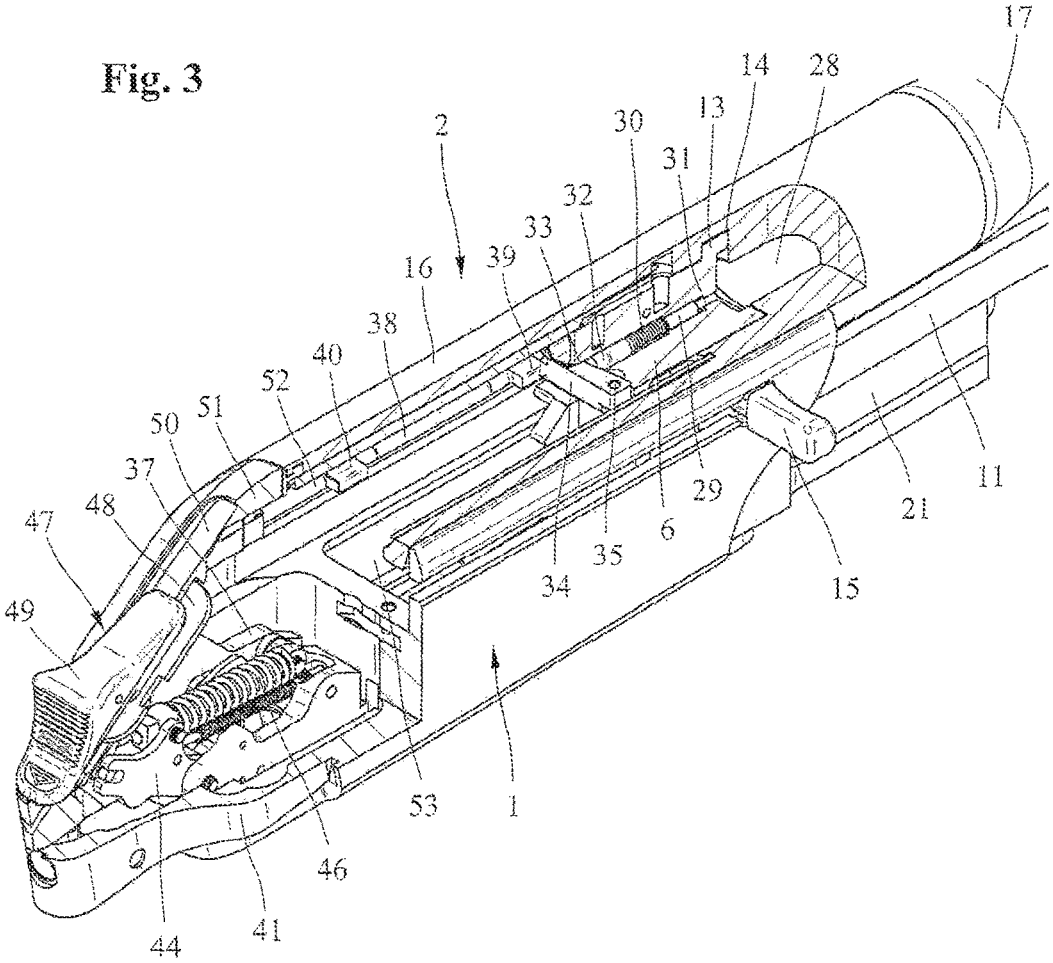
FIG. 3 a partial cutaway perspective view of the rear part of the gas-operated firearm depicted in FIG. 1 with the breech lock in an unlocked position.
Figure 4:
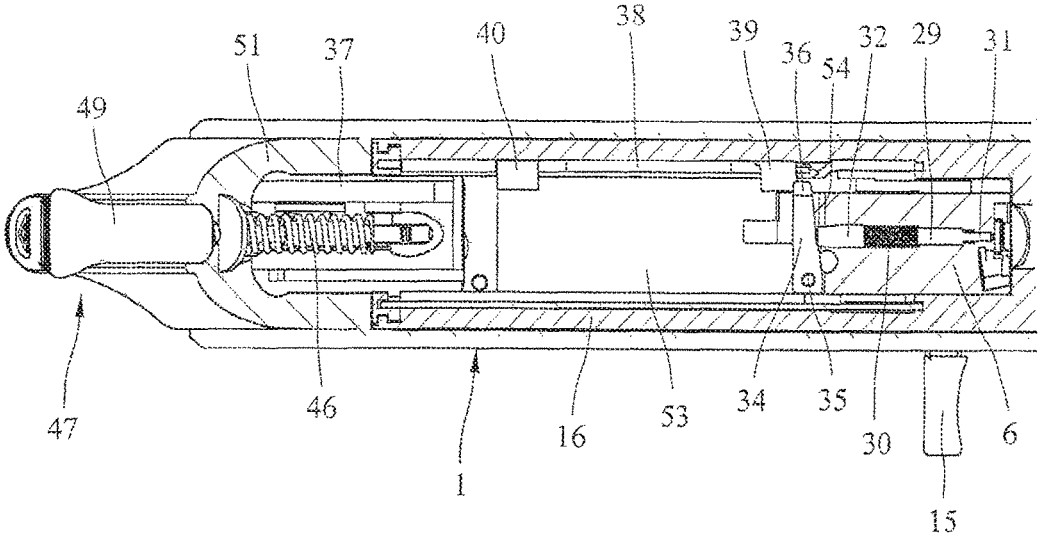
FIG. 4 shows a longitudinal section of the rear part of the gas-operated firearm depicted in FIG. 3 with the breech lock in the unlocked position.

A chamber 28 provided in barrel 2 is closed off downward by the bolt 6 depicted in cross section in FIGS. 3 and 4. A firing pin 29 is guided to move axially in the bolt 6. A firing pin spring 30, arranged around firing pin 29, is also accommodated in the bolt 6, through which the front tip 31 of the firing pin 29 is forced into a retracted position. The rear end 32 of firing pin 29, viewed in the direction of firing, lies on a lever-like cocking element 34 arranged to pivot in a transverse groove 33 on the rear end of bolt 6. The lever-like cocking element 34 is connected to the bolt 6 with its one end to pivot about a pin 35 laterally offset relative to the longitudinal axis of the bolt 6 and perpendicular to the longitudinal axis. The free other end 36 of the lever-like cocking element 34 protrudes laterally from the bolt 6 according to FIG. 2.

A firearm lock with a cocking piece 37 movable between a rear initial position and a front triggering position for activation of the firing pin 29 arranged in bolt 6 via a hammer strut 38 and the lever-like locking element 34 on bolt 6 is shown in FIG. 2. A hammer mechanism for operation of the firing pin 29 arranged in the bolt 6 is formed by the cocking piece 37, the hammer strut 38 and the lever-like cocking element 34. The hammer strut 38 offset parallel to the center axis of the bolt 6 has a front crosspiece 39 that comes to a stop on its front end with the protruding end 36 with a lever-like cocking element 34 and a rear crosspiece 40 that cooperates with the cocking piece 37.

The cocking piece 37 is mounted to rotate on a lock carrier 41 insertable into housing 1 around a cross pin 42. A slide stop 43 is also arranged on the lock carrier 41, via which the cocking piece 37 can be held in the rear initial position or released via a trigger not shown here for firing of a shot. A locking lever 44 is also linked on the lock carrier 41 to pivot about another cross pin 45 between a rear uncocked position and a front cocked position. A cocking spring 46 is stretched between the locking lever 44 and the cocking piece 37. Displacement of the locking lever 44 between the rear uncocked position and the front cocked position occurs through a cocking slide 47, which contains a lower part 48 connected to a locking lever 44 and an upper part 49 connected to it. The slide-like upper part 49 operable by the thumb of a shooter is guided according to FIG. 3 in a recess 50 on the oblique top of a rear end 51 of housing 1 so that the cocking slide 47 can be moved between a lower safe position and an upper off-safe position.

It is apparent in FIG. 3 that the hammer strut 38 is guided to move in the longitudinal grove 52 on the inside of the tunnel-like rear part 16 of the barrel 2 offset laterally and parallel to the firing pin 29 and also the center line of barrel 2. The front crosspiece 39 and the rear crosspiece 40 of the hammer strut 38 protrude inwardly, so that they can come to a stop with the cocking element 34 in the bolt 6 and the cocking piece 37. The hammer strut 38 runs above and along a downwardly open magazine shaft 53 arranged in housing 1, into which a magazine can be inserted. The connection between the cocking piece 37 arranged behind the magazine shaft 53 and the firing pin 29 arranged in bolt 6 can be made via hammer strut 38. The lever-like cocking element 34 according to FIG. 4 is designed in the form of wedge with an oblique surface 54 facing the firing pin 29.

The breech lock is shown in an unlocked position in FIGS. 3 and 4. The cocking slide 47 is situated in the lower safe position so that the locking lever 44 is also situated in a rear locked position and the main spring 46 is unlocked. In this position of the cocking slide 47 the cocking piece 37 held in the rear starting position cannot be knocked off even during operation of the trigger.

Figure 5:
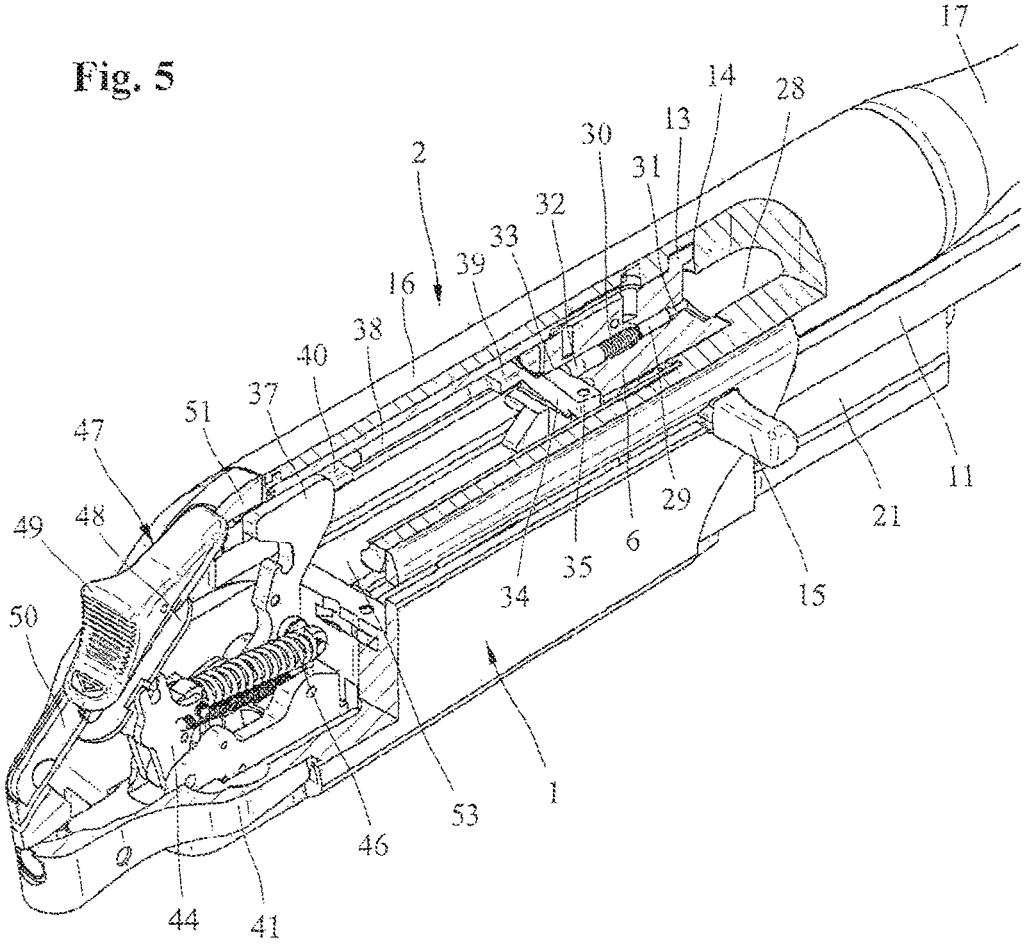
FIG. 5 shows a partial cutaway perspective view of the rear part of the gas-operated firearm depicted in FIG. 1 with the breech lock in the locked position.
Figure 6:
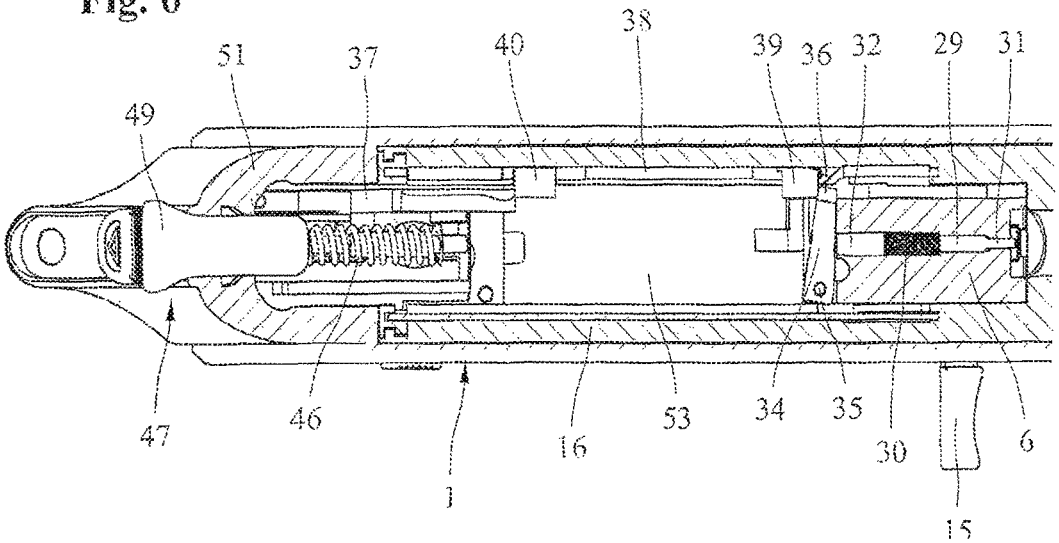
FIG. 6 shows a longitudinal section of the rear part of the gas-operated firearm depicted in FIG. 5 with the breech lock in the locked position.

Only when the cocking slide 47 is pushed upward into the upper off-safe position depicted in FIGS. 5 and 6 does the locking lever 44 also enter the front cocked position, so that the main spring 46 is tensioned and the breech lock is therefore in a cocked position. If the trigger is then operated, the cocking piece 37 can reach the depicted front firing position through the force of the tightened main spring 46, in which case the cocking piece 37 pushes the hammer strut 38 forward (viewed in the direction of firing) and the hammer strut 38 via the lever-like cocking element 34 also forces the firing pin 29 within bolt 6 forward to release a shot against the force of the firing pin spring 30.

When a shot is fired, some of the powder gases are guided into gas cylinder 24 through the gas-discharge hole 25 of barrel 2. The pressure piston 26 is forced rearward, viewed in the direction of firing, by the gas pressure taken off in gas cylinder 24. The bolt-operating device 5 with the carrier 10 and the two push rods 11 is then also pushed rearward against the force of recoil spring 7. The bolt 6 can be moved downwards by the backward movement of the two push rods 11, so that the locking block 13 is unlocked on barrel 2 and the bolt 6 can open the chamber rearwards in barrel 2. During backward movement of the bolt 6, the empty cartridge is ejected via the ejection opening 18 and the breech lock is locked. A new cartridge can then be brought to the level of the chamber via the magazine spring of a magazine (not shown here). The bolt 6 is forced forward by the recoil spring 7 via the bolt-operating device 5 with the carrier 10 and the two push rods 11 and the new cartridge forced into the chamber. The bolt 6 goes back to the locked position and the bolt is closed via the control cam on the push rods 11.

LIST OF REFERENCE NUMBERS

1 Housing
2 Barrel
3 Front shaft
4 Guide rod

5 Bolt-operating device
6 Bolt
7 Main spring (recoil or bolt spring)
8 External threads
9 Threaded sleeve
10 Carrier
11 Push rods
12 Protrusions
13 Locking block
14 Locking groove
15 Bolt handle
16 Rear part of barrel
17 Front part of barrel
18 Ejection opening
19 Retaining pin
20 Holes
21 Support part
22 Nuts
23 Gas-discharge block
24 Gas cylinder
25 Gas-discharge hole
26 Pressure piston
27 Piston rod
28 Chamber
29 Firing pin
30 Firing pin spring
31 Front end of firing pin
32 Rear end of firing pin
33 Transverse groove
34 Cocking element
35 Pin
36 Free end of cocking piece
37 Cocking piece
38 Hammer strut
39 Front crosspiece
40 Rear crosspiece
41 Lock carrier
42 Cross pin
43 Slide stop
44 Locking lever
45 Cross pin
46 Cocking spring
47 Cocking slide
48 Lower part
49 Upper part
50 Recess
51 End part
52 Longitudinal groove
53 Magazine shaft
54 Oblique surface

What is claimed is:

1. A firearm comprising:
a housing;
a barrel fastened to the housing;
a chamber within the barrel;
a bolt for closing the chamber;
a magazine shaft within the barrel, the magazine shaft configured for receiving a magazine;
a firing pin arranged within the bolt; and
a hammer mechanism arranged for operating the firing pin; the hammer mechanism including:
a cocking piece movable in a direction of firing between a first inactive position and a second triggering position for activating the firing pin;
a hammer strut arranged between the cocking piece and the firing pin, the hammer strut running above and along the magazine shaft; and
a cocking element operable by the hammer strut arranged on the bolt and contacting the firing pin.

2. The firearm according to claim 1, wherein the barrel comprises a longitudinal groove on an inner surface parallel to a center line of the barrel.

3. The firearm according to claim 2, wherein the hammer strut is configured to move within the longitudinal groove.

4. The firearm according to claim 1, wherein the hammer strut comprises a front crosspiece at a first end adjacent the cocking element and a rear crosspiece at a second end adjacent the cocking piece, the front crosspiece and the rear crosspiece for operatively-connecting the cocking piece with the firing pin.

5. The firearm according to claim 1, wherein the cocking element is formed as a lever connected at one end to the bolt, the cocking element pivotable about a pin offset laterally relative to a longitudinal axis of the bolt and perpendicular to the longitudinal axis of the bolt.

6. The firearm according to claim 5, wherein the bolt comprises a transverse groove at a rear end.

7. The firearm according to claim 6, wherein the cocking element is pivotable in the transverse groove.

8. The firearm according to claim 1, wherein the cocking element comprises a free end protruding laterally relative to the bolt, the free end configured for contacting the hammer strut.

9. The firearm according to claim 1, wherein the cocking element is formed as a wedge having an oblique surface facing the firing pin.

10. The firearm according to claim 1, further comprising a lock carrier, the lock carrier configured for insertion into the housing.

11. The firearm according to claim 10, wherein the cocking piece is rotable around a cross pin in the locking carrier, the cocking piece configured to be held in place or released for firing of a shot.

12. The firearm according to claim 10, wherein the lock carrier further comprises a locking lever.

13. The firearm according to claim 12, further comprising a cocking spring stretched between the cocking piece and the locking lever.

14. The firearm according to claim 13, further comprising a cocking slide, a lower end of the cocking slide operatively-connected to the locking lever.

15. The firearm according to claim 14, wherein the locking lever is movable in a direction of fire by the cocking slide from an uncocked position into a cocked position.

16. The firearm according to claim 15, further comprising a recess configured for guiding the cocking slide on an oblique surface of the housing from the uncocked position into the cocked position.

17. A firearm comprising:
a housing;
a barrel fastened to the housing, the barrel having a longitudinal groove on an inner surface parallel to a center line of the barrel;
a chamber within the barrel;
a bolt for closing the chamber;
a magazine shaft within the barrel, the magazine shaft configured for receiving a magazine;
a firing pin arranged within the bolt; and
a hammer mechanism arranged for operating the firing pin; the hammer mechanism including:
a cocking piece movable in a direction of firing between a first inactive position and a second triggering position for activating the firing pin;

a hammer strut arranged between the cocking piece and the firing pin, the hammer strut running above and along the magazine shaft and configured to move within the longitudinal groove; and a cocking element operable by the hammer strut arranged on the bolt and contacting the firing pin.

18. The firearm according to claim 17, wherein the hammer strut comprises a front crosspiece at a first end adjacent the cocking element and a rear crosspiece at a second end adjacent the cocking piece, the front crosspiece and the rear crosspiece for operatively-connecting the cocking piece with the firing pin.

19. The firearm according to claim 17, wherein the cocking element is formed as a lever connected at one end to the bolt, the cocking element pivotable about a pin offset laterally relative to a longitudinal axis of the bolt and perpendicular to the longitudinal axis of the bolt.

20. The firearm according to claim 19, wherein the cocking element is pivotable in a transverse groove at a rear end of the bolt.

* * * * *